US006971336B1

(12) United States Patent
Chojnacki et al.

(10) Patent No.: US 6,971,336 B1
(45) Date of Patent: Dec. 6, 2005

(54) SUPER LOW $NO_X$, HIGH EFFICIENCY, COMPACT FIRETUBE BOILER

(75) Inventors: Dennis A. Chojnacki, Schaumburg, IL (US); Iosif K. Rabovitser, Skokie, IL (US); Richard A. Knight, Brookfield, IL (US); David F. Cygan, Villa Park, IL (US); Jacob Korenberg, York, PA (US)

(73) Assignee: Gas Technology Institute, Des Plaines, IL (US)

( * ) Notice: Subject to any disclaimer, the term of this patent is extended or adjusted under 35 U.S.C. 154(b) by 0 days.

(21) Appl. No.: 11/029,946

(22) Filed: Jan. 5, 2005

(51) Int. Cl.[7] ..... F22B 9/08
(52) U.S. Cl. ..... 122/149; 122/75; 122/76
(58) Field of Search ..... 122/44.1, 51, 64, 122/74, 81, 110, 60, 75, 76, 149

(56) References Cited

U.S. PATENT DOCUMENTS 438,872 A * 10/1890 Wilson et al. ..... 110/345
4,004,875 A 1/1977 Zink et al.
4,147,134 A * 4/1979 Vogt et al. ..... 122/5
4,195,596 A * 4/1980 Scheifley et al. ..... 122/149
4,989,549 A 2/1991 Korenberg
5,350,293 A 9/1994 Khinkis et al.
6,289,851 B1 9/2001 Rabovitser et al.
6,338,337 B1 * 1/2002 Panz et al. ..... 126/360.2
6,672,859 B1 1/2004 Rabovitser et al.

* cited by examiner

*Primary Examiner*—Gregory Wilson
(74) *Attorney, Agent, or Firm*—Mark E. Fejer

(57) ABSTRACT

A firetube boiler furnace having two combustion sections and an in-line intermediate tubular heat transfer section between the two combustion sections and integral to the pressure vessel. This design provides a staged oxidant combustion apparatus with separate in-line combustion chambers for fuel-rich primary combustion and fuel-lean secondary combustion and sufficient cooling of the combustion products from the primary combustion such that when the secondary combustion oxidant is added in the secondary combustion stage, the $NO_x$ formation is less than 5 ppmv at 3% $O_2$.

21 Claims, 7 Drawing Sheets

SUPER LOW $NO_X$, HIGH EFFICIENCY, COMPACT FIRETUBE BOILER

The U.S. Government has a paid-up license in this invention and the right in limited circumstances to require the patent owner to license others on reasonable terms as provided for by the terms of Contract No. DE-FC36-00ID13904 awarded by the U.S. Department of Energy.

BACKGROUND OF THE INVENTION

1. Field of the Invention

This invention relates to a process and apparatus for combustion of gaseous and/or liquid fossil fuels which has the potential for increasing thermal efficiency and reducing $NO_x$ emissions from conventional heating apparatuses such as boilers and other fluid heaters, and which makes possible the use of boilers and other fluid heaters having a reduced size in comparison to conventional boilers and fluid heaters having comparable thermal ratings. More particularly, this invention relates to firetube boiler furnaces having a plurality of combustion stages and an in-line intermediate, high-effectiveness, tubular heat exchanger extending between the combustion stages, which design provides for operation of a fuel-rich first combustion stage and a fuel-lean second combustion stage and, more importantly, sufficient cooling of the combustion products from the first combustion stage such that when the secondary combustion oxidant is added in the second combustion stage, the $NO_x$ formation is less than 5 ppmv on a 3%-$O_2$ basis.

2. Description of Related Art

With pollution control requirements becoming increasingly more stringent, it is necessary to decrease $NO_x$ emissions even further than reductions achieved with presently known combustion technologies, preferably without increasing, and possibly even decreasing, the cost of the combustion equipment or its combination with boilers. Conventional combustion of fossil fuels produces elevated temperatures which promote complex chemical reactions between oxygen and nitrogen, forming various oxides of nitrogen as byproducts of the combustion process. These oxides, containing nitrogen in different oxidation states, generally are grouped together under the single designation of $NO_x$. Concern over the role of $NO_x$ and other combustion byproducts, such as sulfur oxides, carbon monoxide, total hydrocarbons and carbon dioxide in "acid rain" and other environmental problems is generating considerable interest in reducing the formation of these environmentally harmful byproducts of combustion.

Known methods of combustion for reducing $NO_x$ emissions from combustion processes include flue gas recirculation and staged combustion. U.S. Pat. No. 4,004,875 teaches a low $NO_x$ burner for combustion of liquid and gaseous fuels in which the combustion area is divided into at least two stages and combustion products are recirculated, cooled, and reintroduced into the primary combustion zone, resulting in a reduction of $NO_x$ emissions. Secondary combustion air is introduced into a secondary combustion zone downstream of the primary combustion zone in an amount sufficient to complete combustion therein. Fuel and primary combustion air are introduced into a primary combustion zone formed by a burner tile that provides a high temperature environment for the fuel and air mixture to promote combustion. Except for the opening into the secondary combustion zone, the tile is completely surrounded by a steel enclosure forming an annular space around the tile. Thus, as fuel and air are injected into the primary combustion zone, a portion of the partially combusted fuel and air is recirculated around the outside of the tile in the annular space between the tile and the steel enclosure and back into the upstream end of the primary combustion zone.

It is also known that, in addition to limiting the oxygen available in a combustion process for formation of $NO_x$ emissions, $NO_x$, emissions may also be controlled by maintaining the temperature in the combustion zone below the temperature required for formation of significant $NO_x$, about 2600° F. U.S. Pat. No. 4,989,549 teaches an ultra-low $NO_x$ two-stage combustion process in a cyclonic, refractory lined apparatus firing into the cylindrical combustion chamber of a firetube boiler. The first stage combustion is carried out under sub-stoichiometric conditions, i.e. less than the amount of oxygen required for complete combustion of the fuel, and the second stage combustion is carried out at above-stoichiometric conditions, i.e. more than the amount of oxygen required for complete combustion of the fuel. In two embodiments of the combustion apparatus, the first stage combustion occurs directly adjacent the inlet end of the boiler furnace and the second stage combustion occurs inside the boiler furnace which acts as a combustion apparatus. In other embodiments, both the first and second stage combustion occur inside the boiler furnace which acts as a combustion apparatus. Cyclonic combustion is utilized in both stages of the combustion apparatus and heat exchange means surrounding and extending substantially throughout the axial length of the combustion chamber are provided for absorbing heat and cooling the combustion gases therein. It is claimed that, due to the adiabatic sub-stoichiometric combustion in the first stage and the non-adiabatic second stage combustion in the furnace, the combustion temperatures in both stages are significantly reduced compared to conventional systems of the time, thereby resulting in $NO_x$ emissions down to 25 ppmv corrected to 3% $O_2$. However, this patent neither teaches nor suggests the possibility of reducing $NO_x$ emissions to the currently desired level of less than about 5 ppmv corrected to 3% $O_2$.

See also U.S. Pat. No. 5,350,293 which teaches a method and apparatus for combustion of a fuel utilizing air staging in which combustion is carried out in two stages and in which temperature control is achieved by removal of net heat produced by the combustion process from the first stage of the process. However, extracting heat from the combustion process by a heat absorbing surface inserted into the apparatus and transporting it away from the apparatus as taught by this patent represents an impractical concept, especially in the firetube boiler technology which employs natural water circulation in two inside and outside pressurized vessels. Insertion of a forced circulation heat transfer coil into the first stage combustion chamber makes the combustion process and firetube boiler more expensive and complicated, including an addition of electrical consumption for pumping water through the coil.

U.S. Pat. No. 6,289,851 teaches a compact low-$NO_x$, high efficiency heating apparatus having first and second stage combustion chambers, a primary porous matrix chamber disposed there between, a secondary porous matrix chamber, heat exchange tubes for transfer of heat from the combustion products to a working fluid, and a recirculation device for recirculating combustion products to the root of the flames in both the first and second stage combustion chambers. The porous matrix chambers are utilized for intensive heat transfer away from the combustion process to enable $NO_x$ control and provide for a reduced size apparatus.

Heretofore it has been thought to be impractical to utilize staged combustion in a firetube boiler because there is no known way for introducing a secondary stream of oxidant through the pressurized boiler shell into the furnace. Thus, until now, the reduction of $NO_x$ emissions from firetube boilers to the desired super-low level of 5 ppmv at 3% $O_2$ has not been readily achievable.

SUMMARY OF THE INVENTION

Accordingly, it is one object of this invention to provide an apparatus for staged non-adiabatic combustion inside the furnace of a firetube boiler.

It is another object of this invention to provide a firetube boiler capable of reducing $NO_x$ emissions below the level of conventional firetube boilers, down to the super-low level of 5 ppmv at 3% $O_2$.

These and other objects of this invention are addressed by a firetube boiler furnace having two combustion sections and an in-line intermediate tubular heat transfer section between the two combustion sections, which heat transfer section is integral to the pressure vessel. This design provides a staged oxidant combustion apparatus with separate in-line combustion chambers for fuel-rich primary combustion and fuel-lean secondary combustion and, more importantly, sufficient cooling of the combustion products from the primary combustion such that when the secondary combustion oxidant is added in the secondary combustion stage, the $NO_x$ formation is less than 5 ppmv at 3% $O_2$. With the in-line intermediate tubular heat transfer section addition to the firetube boiler and the resulting creation of in-line primary and secondary combustion chambers, the combustion oxidant for the secondary combustion stage can be introduced from a primary combustion oxidant plenum, through the in-line tubular heat transfer section by means of an axial secondary oxidant tube to a secondary combustion oxidant plenum, or from the primary combustion oxidant plenum by means of a plurality of secondary combustion oxidant tubes through the pressure vessel to the secondary combustion oxidant plenum, or through the rear of the boiler by means of an axial secondary combustion oxidant tube penetrating through the rear door of the firetube boiler.

In the primary combustion section of the furnace, the combustion takes place at sub-stoichiometric air/fuel ratio in the range of about 0.50 to about 0.75, such that the $NO_x$ generated in the primary combustion section is less than 1 ppm and the combustion products contain about 6.0% to about 9.0% CO, a corresponding concentration of $H_2$, about 5% $CO_2$, and about 1–3% hydrocarbons, and the combustion products temperature is less than about 2300° F. entering the tube side of the in-line tubular heat transfer section of the furnace. The combustion product gases are cooled in the in-line tubular heat transfer section to less than 1700° F. such that when the secondary combustion oxidant is mixed with the primary combustion products in the secondary combustion section of the furnace, the flame temperature is sufficiently low that the overall $NO_x$ generated in the boiler is less than 5 ppmv on a 3% $O_2$ basis, at low excess air levels in the range of about 5% to about 15% (1.1–3.0 vol % $O_2$, dry basis).

BRIEF DESCRIPTION OF THE DRAWINGS

These and other objects and features of this invention will be better understood from the following detailed description taken in conjunction with the drawings wherein.

DETAILED DESCRIPTION OF THE PRESENTLY PREFERRED EMBODIMENTS

In general terms, the invention claimed herein comprises a firetube boiler having a first pass furnace that is divided into a primary combustion chamber, in-line integral tubular heat transfer section, and a secondary combustion chamber. The in-line integral tubular heat transfer section is constructed of conventional tube sheets with axial firetubes having designs which include dimpled tubes, integral finned tubes, tube inserts, or other tube means suitable for increasing the convective heat transfer on the inside (combustion products gas side) of the tube. The outsides of the axial firetubes are in direct contact with the hot water or steam-water mixture. The second pass of the firetube boiler of this invention comprises a conventional convective section having enhanced heat transfer firetubes, such as dimpled tubes, integral finned tubes, tube inserts, or other tube means to increase the convective heat transfer. A dryback or wetback turning box design allows the first pass furnace gases to turn and enter the second pass convective firetubes. Additional passes can be incorporated into the design to further extract heat from the combustion products.

Figure 1:
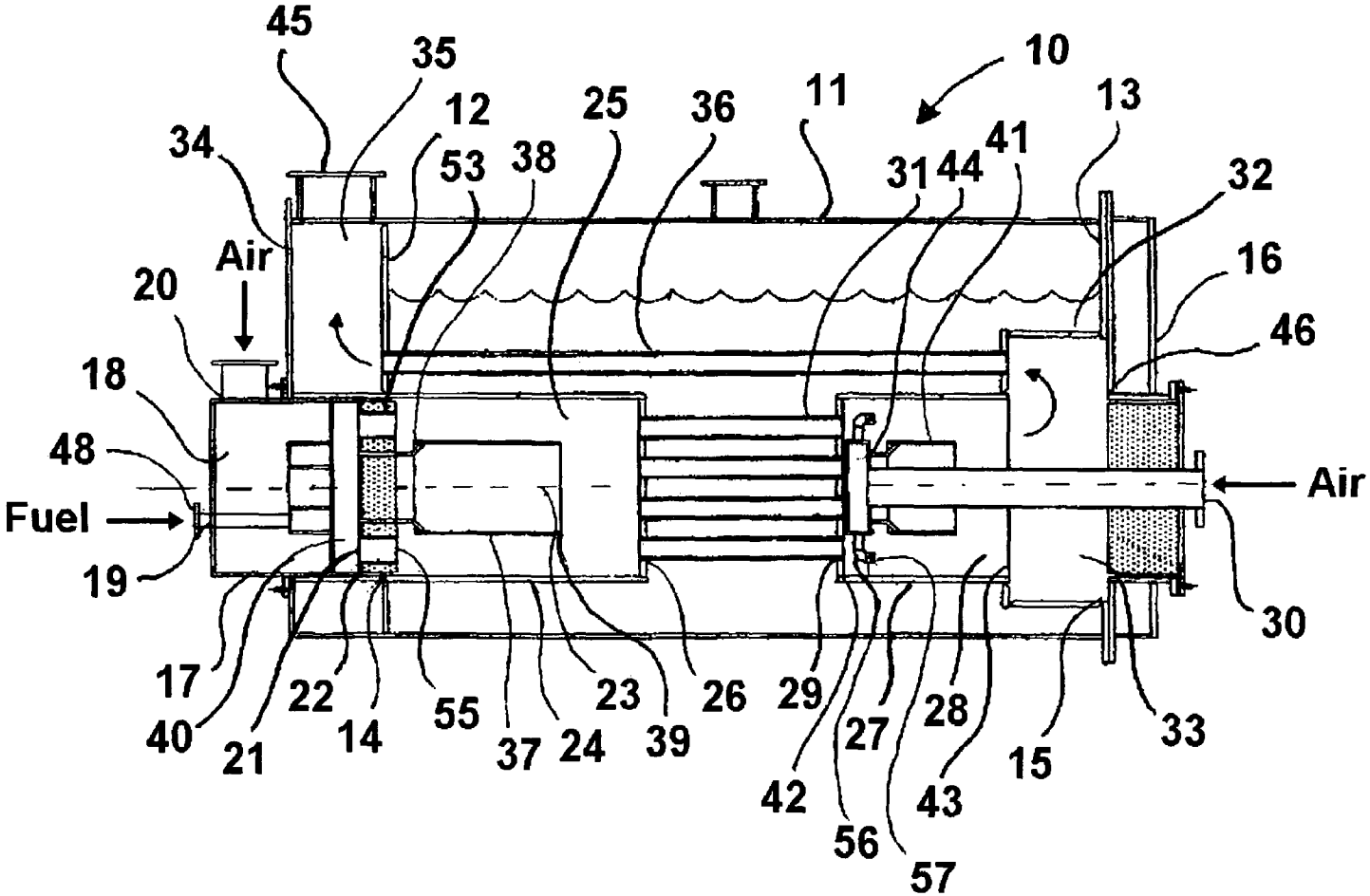
FIG. 1 is a diagram showing a cross-sectional side elevation of a firetube boiler in accordance with one embodiment of this invention.

FIG. 1 shows a fluid heating apparatus in the form of a firetube boiler 10 in accordance with one embodiment of this invention. Firetube boiler 10 comprises an elongated fluid containment vessel 11 having opposed first and second end walls 12 and 13. First end wall 12 forms a first opening 14 and second end wall 13 forms a second opening 15. Second opening 15 is closed off by a fluid-cooled door 16 connected to elongated fluid containment vessel 11. At least one wall 17 encloses a first stage chamber 18, which in the embodiment shown functions as a first stage burner windbox, and forms at least one first stage fuel inlet opening 19, at least one first stage oxidant inlet opening 20 and a plurality of first stage fuel/oxidant outlet openings 21, which in combination constitutes a first stage burner. First stage fuel/oxidant outlet openings 21 are formed by wall 22 disposed on a first stage fuel/oxidant outlet side of first stage chamber 18 and are disposed at at least one radial distance from a center access 23 of first stage chamber 18. Disposed within first stage chamber 18 is a first stage mixing chamber 40. In accordance with this embodiment of the invention, primary oxidant (typically air) is supplied through first stage oxidant inlet opening 20 into first stage chamber 18. Fuel is supplied through fuel tube 48 into first stage mixing chamber 40 in which the primary oxidant and fuel are thoroughly mixed and the fuel/oxidant mixture is directed through first stage fuel/oxidant openings 21 into first stage combustion chamber 25.

At least one first stage combustion chamber wall 24 is connected to the fuel/oxidant outlet side of the first stage chamber 18. Said at least one first stage combustion chamber wall 24 extends through first opening 14, encloses the first stage combustion chamber 25 disposed in fluid containment vessel 11, which first stage combustion chamber 25 is in fluid communication with the first stage fuel/oxidant outlet openings 21, and forms at least one first stage combustion products outlet opening 26.

Figure 6:
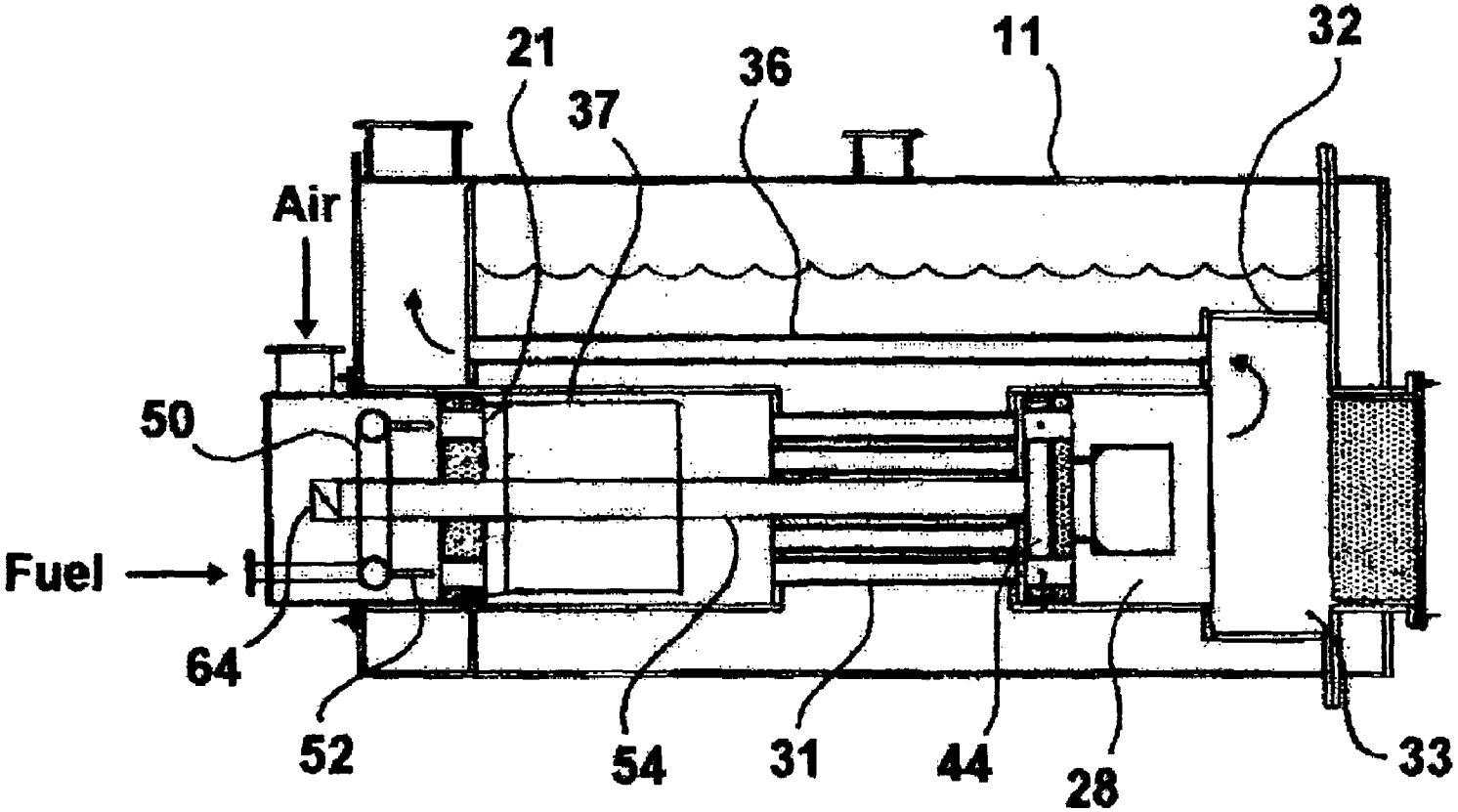
FIG. 6 is a diagram showing a cross-sectional side elevation of a firetube boiler in accordance with a sixth embodiment of this invention.
Figure 7:
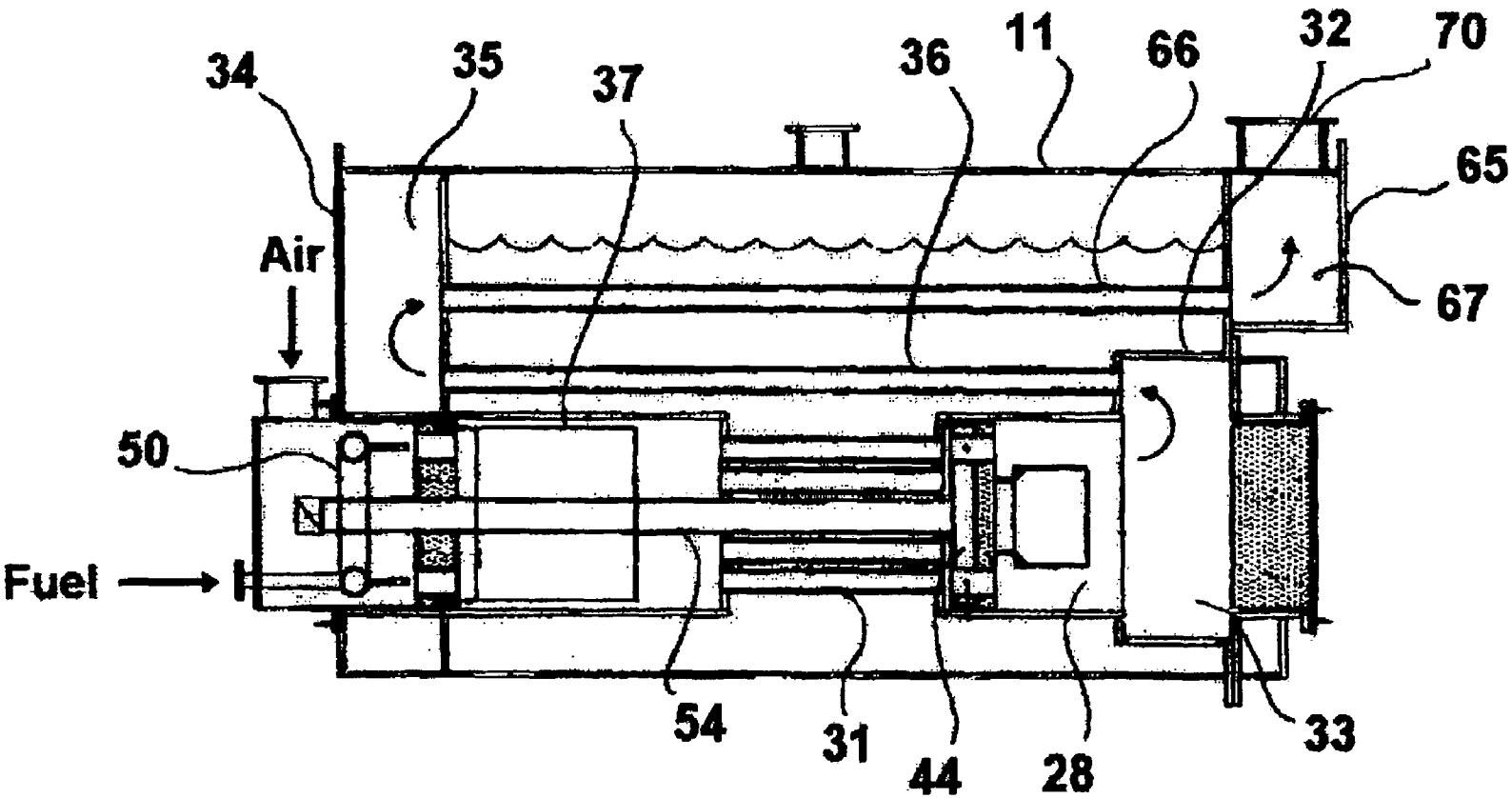
FIG. 7 is a diagram showing a cross-sectional side elevation of a firetube boiler in accordance with a sixth embodiment of this invention.

In accordance with one embodiment of this invention, wall 22 is covered on a side of said wall facing first stage combustion chamber 25 with a refractory layer 53 having openings 55 corresponding to first stage fuel/oxidant openings 21 formed by wall 22, thereby enabling fluid communication between first stage mixing chamber 40 and first stage combustion chamber 25. As shown in FIG. 1, a first stage recirculation sleeve 37 having a combustion products inlet end 38 oriented proximate the fuel/oxidant outlet side of first stage chamber 18 and a recirculated combustion products outlet end 39 distal from the fuel/oxidant outlet side of first stage chamber 18 is disposed in first stage combustion chamber 25. First stage recirculation sleeve 37 is coaxially aligned with center axis 23 of first stage chamber 18 and has a radial distance less than said at least one radial distance of said first stage fuel/oxidant outlet openings 21 from said center axis 23. In accordance with one particularly preferred embodiment of this invention, first stage recirculation sleeve 37 has a radial distance greater than the at least one radial distance of the first stage fuel/oxidant outlet openings 21 from the center axis 23 as shown in FIGS. 6 and 7. First stage recirculation sleeve 37 directs combustion products in a toroidal flow pattern for dilution and cooling of the flame, to stabilize the flame, and to increase radiant heat transfer to the boiler walls.

At least one second stage combustion chamber wall 27 encloses a second stage combustion chamber 28 within fluid containment vessel 11, which second stage combustion chamber is disposed distal from the first end wall 12. Second stage combustion chamber wall 27 forms at least one second stage fuel inlet opening 29, thereby enabling fluid communication with the first stage combustion products outlet openings 26. This fluid communication is further enabled by at least one tubular heat transfer element 31 connecting the first stage combustion products outlet openings 26 of the first stage combustion chamber 25 to the second stage fuel inlet openings 29. Oxidant inlet means are provided for introducing second stage oxidant into the second stage combustion chamber 28.

In accordance with one embodiment of this invention, the oxidant inlet means comprises a second stage oxidant pipe 30, which is connected to a cylindrical second stage oxidant plenum formed by second stage oxidant plenum wall 44. As shown in FIG. 1, second stage oxidant plenum wall 44 forms a plurality of openings to which a corresponding number of L-shaped oxidant spargers 56, evenly distributed around the circumference of the second stage oxidant plenum, are attached with their ultimate ends oriented toward second stage combustion products outlet opening 43 of second stage combustion chamber 28. Each sparger contains a plurality of oxidant nozzles 57, each of which is directed at an angle to the flow of first stage combustion products that have passed through tubular heat transfer elements 31 into second stage combustion chamber 28. In accordance with one embodiment of this invention, a second stage recirculation sleeve 41 having a second stage combustion products inlet end oriented toward secondary oxidant plenum 44 and a second stage recirculated combustion products outlet end oriented toward second stage combustion products outlet opening 43 is disposed within second stage combustion chamber 28. As in the case of the first stage recirculation sleeve, the second stage recirculation sleeve directs combustion products within second stage combustion chamber 28 in a toroidal flow pattern for dilution and cooling of the flame, for stabilizing the flame, and for increasing radiant heat transfer to the boiler walls.

At least one flow control wall 32 is disposed within fluid containment vessel 11 proximate second end wall 13 and encloses a first flow control plenum 33, also known as a rear turning box or wetback, which first flow control plenum is in fluid communication with second stage combustion chamber 28. Said at least one flow control wall 32 forms at least one opening 46 that permits hot combustion products from second stage combustion chamber 28 to contact fluid cooled door 16. At least one second flow control wall 34 is disposed proximate first end wall 12 and forms a second flow control plenum 35, also referred to as a front smoke box, within fluid containment vessel 11. First flow control plenum 33, in addition to being in fluid communication with second stage combustion chamber 28, is also in fluid communication with second flow control plenum 35. This fluid communication is provided by at least one second tubular heat transfer element 36 connecting first flow control plenum 33 with second flow control plenum 35. Second flow control plenum 35 is provided with an opening on top to which at least one combustion products exhaust outlet nozzle 45 is attached.

Figure 2:
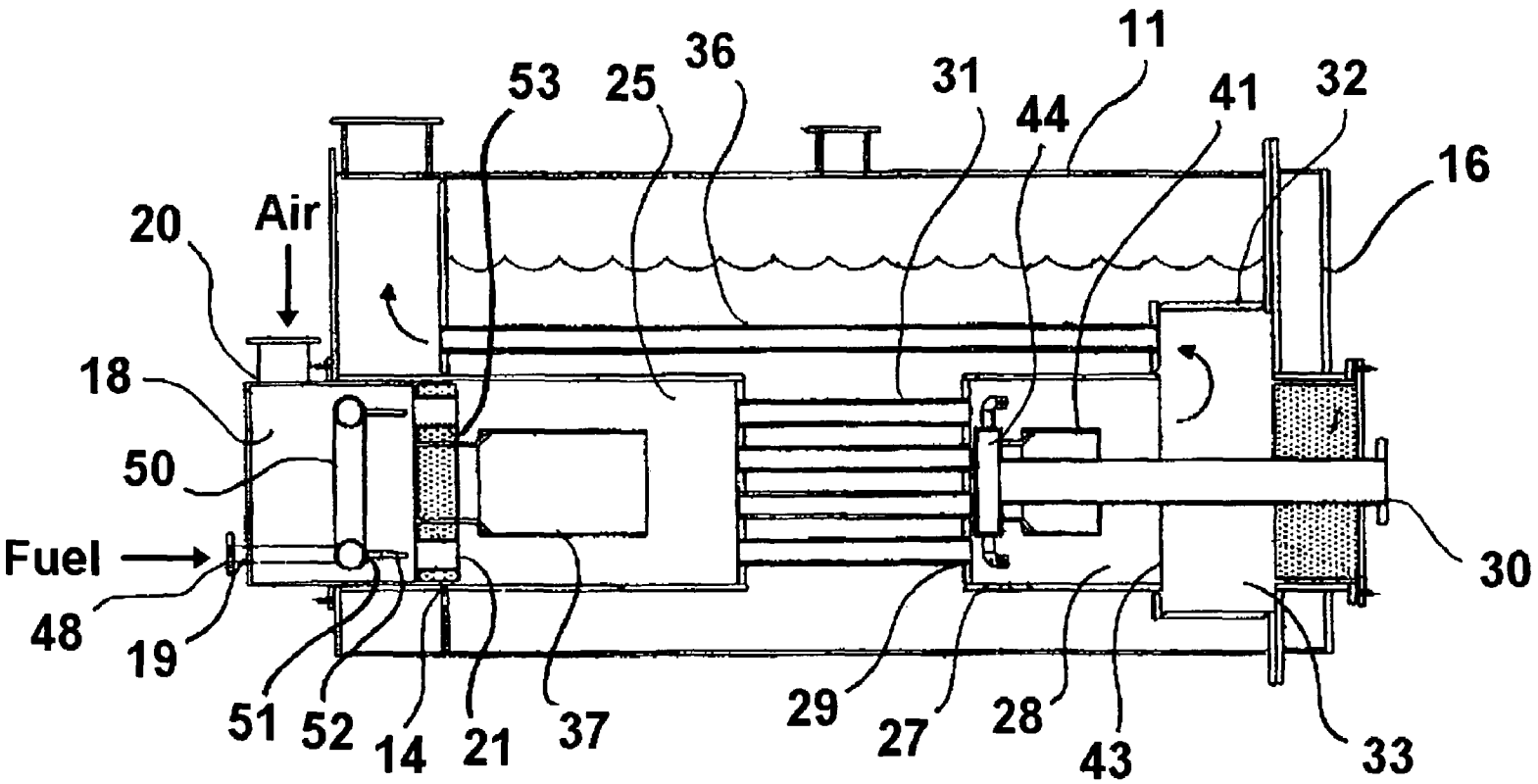
FIG. 2 is a diagram showing a cross-sectional side elevation of a firetube boiler in accordance with a second embodiment of this invention.

In accordance with one embodiment of the invention shown in FIG. 2, mixing of the fuel and first stage oxidant is achieved through nozzle mixing. As shown, fuel is provided by means of fuel tube 48 to a fuel distribution plenum 50 having a plurality of fuel distribution plenum outlet openings 51 disposed within first stage chamber 18. A fuel distribution plenum nozzle 52 corresponding to each fuel distribution plenum outlet opening aligned with each first stage fuel/oxidant opening 21 is connected to the fuel distribution plenum so as to provide fluid communication between fuel distribution plenum 50 and each first stage fuel/oxidant opening 21.

Figure 3:
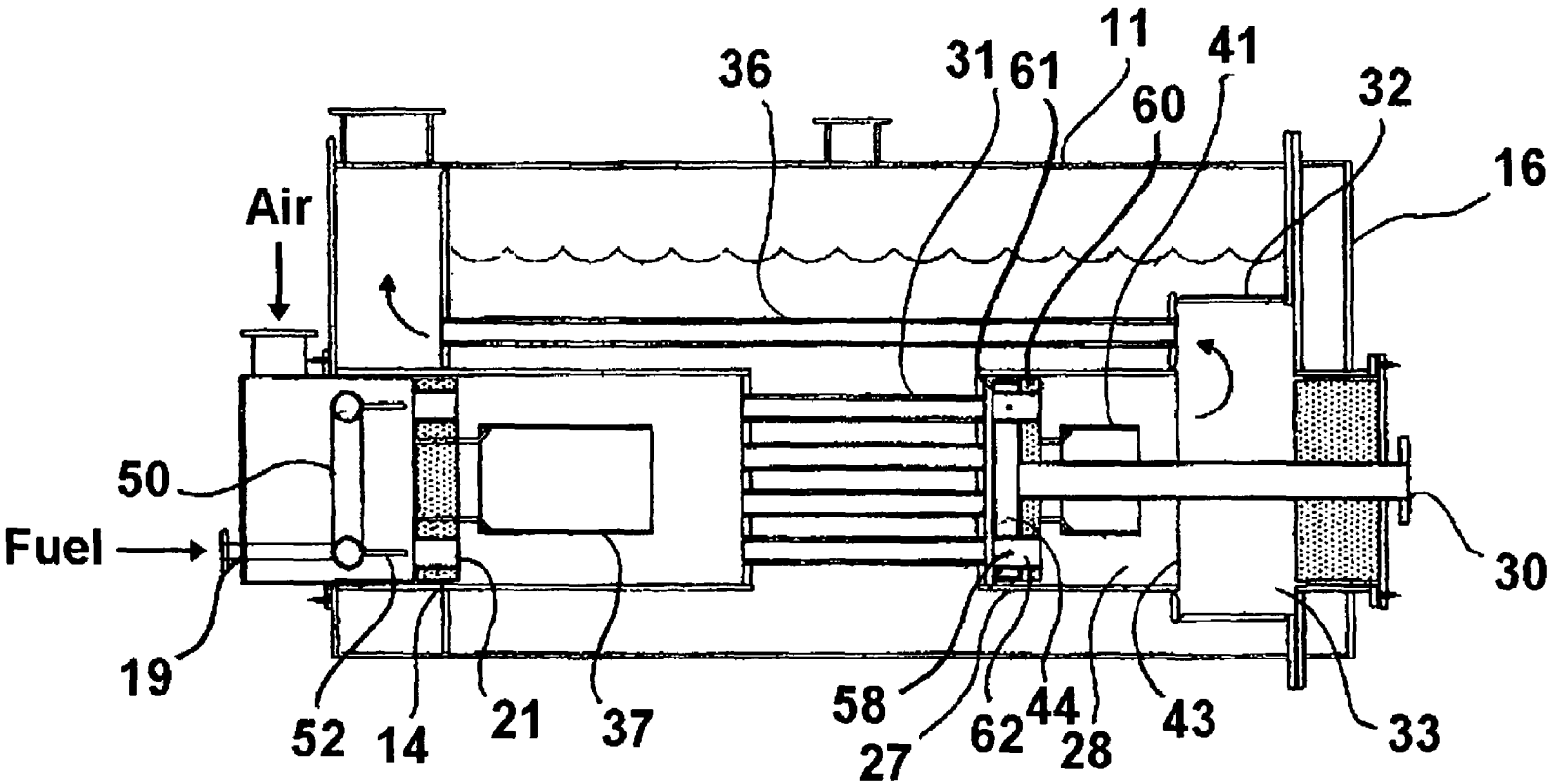
FIG. 3 is a diagram showing a cross-sectional side elevation of a firetube boiler in accordance with a third embodiment of this invention.

FIG. 3 shows yet another embodiment of this invention in which second stage oxidant plenum wall 44 is protected from the high temperature of second stage combustion chamber 28 by a second stage refractory wall 60 which extends outward to contact second stage combustion chamber wall 27 so as to substantially preclude the passage of first stage combustion products exiting first tubular heat transfer elements 31. A cooled primary combustion products space 61 is thus formed between the outlets of first tubular transfer elements 31 and the second stage oxidant plenum formed by second stage oxidant plenum wall 44. A plurality of second stage mixing conduits 62 are located on a circumference of the second stage oxidant plenum and pass longitudinally through both the second stage oxidant plenum and the second stage refractory wall 60, thereby providing fluid communication between the cooled primary combustion products space 61 and the second stage combustion chamber 28. Each of the second stage mixing conduits 62 is provided on its periphery with a plurality of mixing tube oxidant openings 58, whereby second stage oxidant is able to flow from the second stage oxidant plenum into the second stage mixing conduits and mix with the first stage combustion products introduced into second stage combustion chamber 28 through first tubular heat transfer elements 31 prior to ignition in the second stage combustion chamber.

Figure 4:
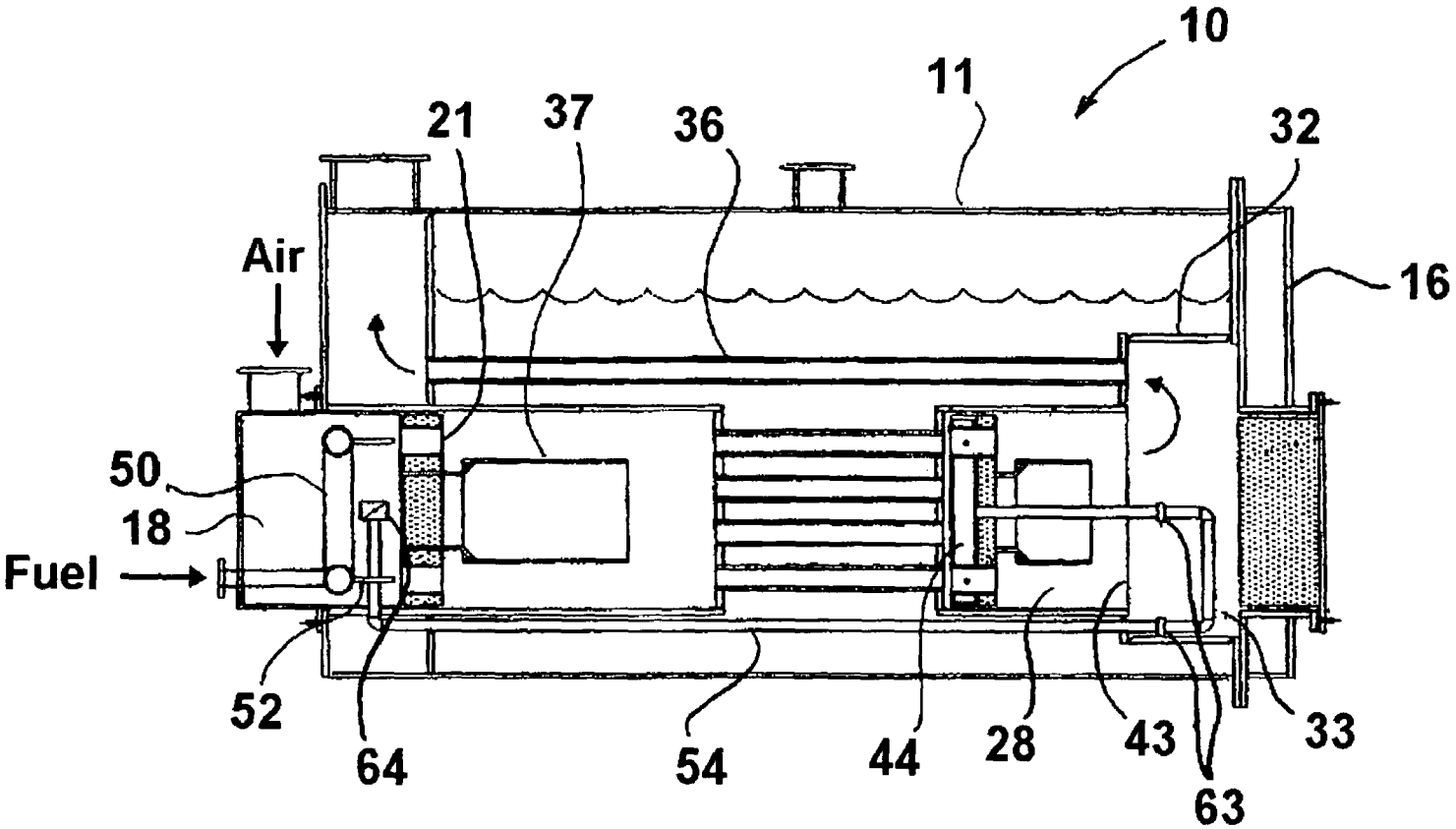
FIG. 4 is a diagram showing a cross-sectional side elevation of a firetube boiler in accordance with a fourth embodiment of this invention.

In accordance with one embodiment of this invention as shown in FIG. 4, second stage oxidant is provided to the second stage oxidant plenum by means of at least one second stage oxidant conduit 54 extending from first stage chamber 18 and terminating in the second stage oxidant plenum. Pipe unions 63 are provided to facilitate disassembly of the second stage oxidant conduit as may be required. Second stage oxidant flow control means 64 consisting of a valve, damper or similar apparatus is provided to control the flow of second stage oxidant.

Figure 5:
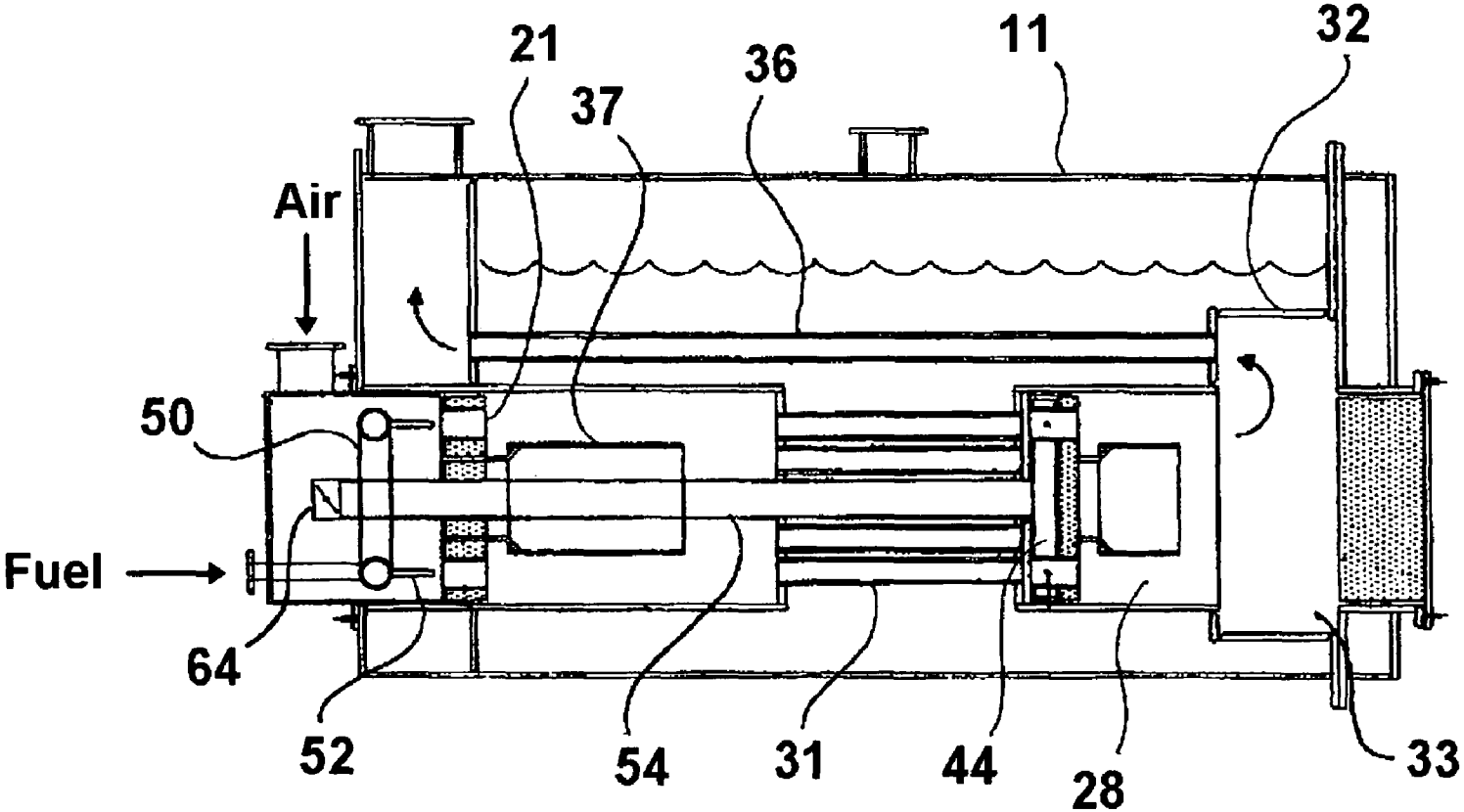
FIG. 5 is a diagram showing a cross-sectional side elevation of a firetube boiler in accordance with a fifth embodiment of this invention.

FIG. 5 shows another embodiment of this invention in which second stage oxidant conduit 54 passes through the first stage combustion chamber, through the array of first tubular heat transfer elements 31, and through the cooled first stage combustion products space 61, providing fluid communication between the first stage chamber 18 and the second stage oxidant plenum. Second stage oxidant flow control means 64 consisting of a valve, damper or similar apparatus is provided to control the flow of second stage oxidant.

In accordance with one embodiment of this invention, at least one additional tubular heat transfer element is disposed downstream of and above second tubular heat transfer element 36, as shown in FIG. 7. In situations in which boiler steam pressure is relatively high, that is, saturation temperature is correspondingly higher, achieving a desired combustion products exhaust gas temperature for relatively high boiler efficiency becomes very difficult, if not impossible. For this reason, an additional heating surface may be required. As shown in FIG. 7, the apparatus of this invention further comprises a third flow control wall 65 forming a third flow control plenum 67. Third tubular heat transfer element 66 is disposed between second flow control plenum 35 and third flow control plenum 67, providing fluid communication there between. In this case, rather than being exhausted through combustion products exhaust tube 45, the flow of combustion products exiting second tubular heat transfer element 36 is reversed to enable the passage of the combustion products through the third tubular heat transfer element 66 into third flow control plenum 67 and out through combustion products exhaust tube 70.

In accordance with one preferred embodiment of this invention, at least one of first stage recirculation sleeve 37 and second stage recirculation sleeve 41 comprises a coating on the flame side of the recirculation sleeve. By flame side, we mean the surface of the recirculation sleeve facing the flame in the respective combustion chambers. Thus, in those instances in which the recirculation sleeve has a radial distance less than the at least one radial distance of the first stage fuel/oxidant outlet openings 21 from the center axis 23, it is the outer surface of the recirculation sleeve that is coated. Suitable coatings are made of materials capable of withstanding direct exposure to the flame, such as ceramic and refractory materials.

In operation, first stage fuel and oxidant are introduced by means of first stage chamber 18 into first stage combustion chamber 25 in which the fuel is combusted. As used herein, the term "oxidant", in addition to air, also includes oxygen-enriched air and oxygen, and where reference herein is made to the use of air as the combustion oxidant, it will be understood that oxygen-enriched air or oxygen may be substituted therefor. The combustion of fuel within first stage combustion chamber 25 is carried out with less than the stoichiometric requirement of oxidant, resulting in fuel-rich combustion, producing combustion products comprising combustible components, such as CO and unburned hydrocarbons and $NO_x$ formation in the first stage combustion chamber of less than 1 ppmv. The combustion products generated in first stage combustion chamber 25 pass through first stage combustion products outlet openings 26 into said at least one first tubular heat transfer element 31 and from first tubular heat transfer element 31 through second stage fuel inlet opening 29 and into second stage combustion chamber 28 in which combustion of the combustible components occurs. As the combustion products generated in first stage combustion chamber 25 pass through first tubular heat transfer element 31, heat from the combustion products is transferred through the walls of tubular heat transfer element 31 into the fluid disposed within fluid containment vessel 11. To promote the rapid transfer of heat from the combustion products into the fluid, a plurality of tubular heat transfer elements 31, referred to herein as a tubular heat transfer element array, are provided. Heat release rates are such that the combustible gas temperature at the exit of the first stage combustion chamber is about 2300° F. or less. In addition, the integral tubular heat transfer elements 31 cool the combustible gases from the first stage combustion chamber to about 1700° F. or less.

In accordance with one embodiment of this invention, the cooled products of combustion from the first stage combustion chamber have in the range of about 1–2% highly reactive hydrocarbons, such as acetylene and ethylene which, when reacted with oxygen from the combustion oxidant in the second stage combustion chamber, form radicals such as HCCO that help to reduce $NO_x$ formation in the second stage combustion chamber. Depending upon the properties of the fuel, its calorific value and the desired flexibility for achieving different levels of $NO_x$, this invention may be implemented as a two-stage combustion process with both air and fuel staging without changing the overall boiler design.

Although it is preferred that the high combustion efficiency, super-low $NO_x$ apparatus concept disclosed herein be used in a firetube boiler configuration, it is to the understood that this concept may be used in an apparatus having different configurations, and such configurations are deemed to be within the scope of this invention. By way of example, such an apparatus may comprise a first combustion chamber with a substantially cylindrical longitudinally extending wall which is substantially cooled and having a front opening for a burner sub-stoichiometrically firing gaseous fuel into it. The far end of the first combustion chamber corresponds to the upstream end of a tubular intermediate heat transfer surface absorbing the sensible heat of the combustion products generated in the first combustion chamber. The downstream end of the tubular intermediate heat transfer surface corresponds to the upstream end of a second combustion chamber with a substantially cylindrical longitudinally extending wall which is substantially cooled. The second combustion chamber is in fluid communication with a turning box, the walls of which are also substantially cooled. The turning box wall proximate the second combustion chamber has an opening concentric with the second combustion chamber through which a burner longitudinally extending into the second combustion chamber through the turning box wall distal from the second stage combustion chamber introduces secondary air or gaseous fuel and air into the second combustion chamber for above-stoichiometric combustion. Part of the distal turning box wall is used for connecting a tubular heat transfer surface substantially cooled and longitudinally extending to the downstream end of the first combustion chamber.

It will be apparent to those skilled in the art that modifications and variations may be made in the apparatus of this invention without departing from the spirit or the scope of the general inventive concept, and such modifications and variations are deemed to be within the scope of this invention.

We claim:

1. A fluid heating apparatus comprising:

an elongated fluid containment vessel having opposed first and second end walls, said first end wall forming a first opening adapted to receive a burner and said second end wall forming a second opening, said second opening closed off by a fluid-cooled door connected to said fluid containment vessel;

a first stage burner secured to said first end wall, said first stage burner having a first stage fuel inlet, a first stage oxidant inlet, a first stage fuel outlet opening and a first stage oxidant outlet opening, and a first stage combustion chamber wall enclosing a first stage combustion chamber and forming at least one first stage combustion products outlet opening, said first stage combustion chamber disposed within said fluid containment vessel;

a second stage burner disposed within said fluid containment vessel, said second stage burner having a second stage fuel inlet, a second stage oxidant inlet, and a second stage combustion chamber wall enclosing a second stage combustion chamber and forming at least one second stage combustion products outlet opening;

at least one first tubular heat transfer element connecting said at least one first stage combustion products outlet opening to said second stage fuel inlet and providing fluid communication therebetween;

at least one flow reversal wall forming a first flow reversal plenum within said fluid containment vessel, said first flow reversal plenum in fluid communication with said second stage combustion products outlet opening;

at least one combustion products exhaust wall forming a combustion products exhaust plenum disposed within said fluid containment vessel downstream of said first flow reversal plenum, said combustion products exhaust plenum in fluid communication with said first flow reversal plenum; and at least one second tubular heat transfer element providing said fluid communication between said first flow reversal plenum and said combustion products exhaust plenum.

2. An apparatus in accordance with claim 1, wherein said at least one first stage combustion chamber wall forms a plurality of openings providing fluid communication between said at least one first stage fuel inlet and said first stage combustion chamber.

3. An apparatus in accordance with claim 1 further comprising at least one first stage mixer wall forming a first stage mixing chamber in fluid communication with said first stage fuel inlet, said first stage oxidant inlet and said first stage combustion chamber disposed upstream of said first stage combustion chamber.

4. An apparatus in accordance with claim 1 further comprising a first stage recirculation sleeve disposed within said first stage combustion chamber, said first stage recirculation sleeve coaxially aligned with a first stage burner center axis of said first stage burner and having a first stage combustion products inlet end and a recirculated first stage combustion products outlet end.

5. An apparatus in accordance with claim 4 further comprising a second stage recirculation sleeve disposed within said second stage combustion chamber, said second stage recirculation sleeve coaxially aligned with a second stage burner center axis of said second stage burner and having a second stage combustion products inlet end and a recirculated second stage combustion products outlet end.

6. An apparatus in accordance with claim 5, wherein at least one surface of at least one of said first stage recirculation sleeve and said second stage recirculation sleeve is coated with a protective material.

7. An apparatus in accordance with claim 5, wherein said second stage burner comprises at least one second stage oxidant plenum wall enclosing a second stage oxidant plenum upstream of said second stage recirculation sleeve.

8. An apparatus in accordance with claim 4, wherein said first stage recirculation sleeve has a radial distance less than at least one radial distance of said first stage fuel outlet opening from said center axis.

9. An apparatus in accordance with claim 4, wherein said first stage recirculation sleeve has a radial distance greater than at least one radial distance of said first stage fuel outlet opening from said center axis.

10. An apparatus in accordance with claim 1 further comprising at least one first stage fuel distributor wall enclosing a fuel distribution plenum and forming said at least one first stage fuel outlet opening, said at least one first stage fuel outlet opening aligned with said at least one first stage oxidant outlet opening, whereby fuel and oxidant mix prior to entry into said first stage combustion chamber.

11. A fluid heating apparatus comprising:

an elongated fluid containment vessel having opposed first and second end walls, said first end wall forming a first opening and said second end wall forming a second opening, said second opening closed off by a fluid-cooled door connected to said fluid containment vessel;

at least one wall enclosing a first stage chamber and forming at least one first stage fuel inlet opening, at least one first stage oxidant inlet opening and a plurality of first stage fuel/oxidant outlet openings, said plurality of first stage fuel/oxidant outlet openings formed by a portion of said at least one wall disposed on a first stage fuel/oxidant outlet side of said first stage chamber and disposed at at least one radial distance from a center axis of said first stage chamber;

at least one first stage combustion chamber wall connected to said fuel/oxidant outlet side of said chamber, extending through said first opening, enclosing a first stage combustion chamber disposed in said fluid containment vessel in fluid communication with said fuel/oxidant outlet openings and forming at least one first stage combustion products outlet opening;

at least one second stage combustion chamber wall enclosing a second stage combustion chamber disposed within said fluid containment vessel distal from said first end wall, said second stage combustion chamber wall forming at least one second stage fuel inlet opening in fluid communication with said at least one first stage combustion products outlet opening;

oxidant inlet means for introducing second stage oxidant into said second stage combustion chamber;

at least one first tubular heat transfer element connecting said at least one first stage combustion products outlet opening to said second stage fuel inlet opening;

at least one flow control wall forming a first flow control plenum within said fluid containment vessel proximate said second end wall, said first flow control plenum in fluid communication with said second stage combustion chamber;

at least one second flow control wall forming a second flow control plenum disposed within said fluid containment vessel proximate said first end wall, said second flow control plenum in fluid communication with said first flow control plenum; and at least one second tubular heat transfer element connecting said first flow control plenum to said second flow control plenum.

12. An apparatus in accordance with claim 11 further comprising a first stage recirculation sleeve disposed in said first stage combustion chamber and coaxially aligned with said center axis, said first stage recirculation sleeve having a combustion products inlet end proximate said fuel/oxidant outlet side of said first stage chamber and a recirculated combustion products outlet end distal from said fuel/oxidant outlet side of said first stage chamber.

13. An apparatus in accordance with claim 12 further comprising a second stage recirculation sleeve disposed within said second stage combustion chamber, said second stage recirculation sleeve coaxially aligned with said center axis and having a second stage combustion products inlet end oriented towards said first stage combustion chamber and a recirculated second stage combustion products outlet end distal from said first stage combustion chamber.

14. An apparatus in accordance with claim 13 further comprising at least one second stage oxidant plenum wall disposed within said second stage combustion chamber enclosing a second stage oxidant plenum upstream of said second stage recirculation sleeve, said second stage oxidant plenum wall forming at least one second stage oxidant outlet opening, thereby providing fluid communication with said second stage combustion chamber.

15. An apparatus in accordance with claim 14, wherein a refractory material is disposed on a side of said second stage oxidant plenum facing said second stage recirculation sleeve, said refractory material forming at least one refractory opening aligned with said at least one second stage oxidant outlet opening.

16. An apparatus in accordance with claim 14, wherein at least one mixing tube having a longitudinal axis is disposed within said second stage oxidant plenum and aligned with said at least one second stage oxidant outlet opening, said longitudinal axis oriented substantially parallel to said central axis and said at least one mixing tube in fluid communication with said at least one first tubular heat transfer element.

17. An apparatus in accordance with claim 16, wherein a mixing tube wall of said mixing tube forms at least one mixing tube opening, providing fluid communication between said second stage oxidant plenum and an interior of said mixing tube.

18. An apparatus in accordance with claim 11 further comprising mixing means for mixing fuel and oxidant in said first stage chamber.

19. An apparatus in accordance with claim 18, wherein said mixing means comprises at least one first stage mixer wall forming a first stage mixing chamber in fluid communication with said first stage fuel inlet, said first stage oxidant inlet and said first stage fuel/oxidant outlet openings.

20. An apparatus in accordance with claim 11 further comprising at least one fuel distribution plenum wall disposed within said first stage chamber enclosing a first stage fuel distribution plenum and forming at least one fuel distribution plenum outlet opening aligned with each of said fuel/oxidant outlet openings.

21. An apparatus in accordance with claim 11 further comprising at least one third flow control wall forming a third flow control plenum disposed within said fluid containment vessel proximate said second end wall, said third flow control plenum in fluid communication with said second flow control plenum, and at least one third tubular heat transfer element connecting said second flow control plenum to said third flow control plenum.

* * * * *